United States Patent [19]

Kirk et al.

[11] 4,201,016

[45] May 6, 1980

[54] APPARATUS FOR GRINDING A WORKPIECE

[75] Inventors: Calvin K. Kirk, Shrewsbury; Glover C. Joyce; Francis L. Messier, both of Worcester, all of Mass.

[73] Assignee: The Warner & Swasey Company, Cleveland, Ohio

[21] Appl. No.: 886,996

[22] Filed: Mar. 16, 1978

[51] Int. Cl.[2] ..... B24B 5/04

[52] U.S. Cl. ..... 51/105 SP; 51/165.77; 51/238 S

[58] Field of Search ..... 51/105 SP, 238 S, 238 GG, 51/105 R, 165.77

[56] References Cited

U.S. PATENT DOCUMENTS

| | | | |
|---|---|---|---|
| 2,756,551 | 7/1956 | Alvord | 51/238 S |
| 3,076,296 | 2/1963 | Joyce | 51/165.91 |
| 3,233,368 | 2/1966 | Price | 51/238 S X |
| 3,391,500 | 7/1968 | Messier | 51/238 S |
| 3,878,651 | 4/1975 | Nakada et al. | 51/105 SP |
| 3,977,129 | 8/1976 | Bottomley | 51/238 S X |

*Primary Examiner*—Harold D. Whitehead
*Assistant Examiner*—Robert P. Olszewski

[57] ABSTRACT

An improved grinding method and apparatus is advantageously used to sequentially grind the pins of a crankshaft. During the grinding of each crankpin, the pin is supported by a steadyrest. During an initial grinding operation, the crankpins are measured or gauged to determine if they are out-of-round by an amount which is greater than the tolerances for the finished crankshaft and less than a maximum amount. If a crankpin is out-of-round by an amount which is equal to or greater than a maximum amount, the crankshaft is rejected. However, if a crankpin is out-of-round by an amount which is less than the maximum amount and more than the tolerances for a finished pin, a second grinding operation is initiated after the initial grinding operation has been completed. During the initial and second grinding operations, a main drive motor is effective to press the steadyrest against the crankpins. A secondary drive motor is provided to adjust the position of the steadyrest to compensate for the smaller size to which the crankpins are ground during the second grinding operation. The finished crankshaft is removed from the grinding machine only after both the initial and second grinding operations have been completed. When the number of consecutive out-of-round crankpins and/or crankshafts becomes excessive, a control signal initiates shutting down of the grinding machine and the establishing of an alarm to prevent the grinding of a large number of out-of-round crankshafts.

16 Claims, 10 Drawing Figures

APPARATUS FOR GRINDING A WORKPIECE

BACKGROUND OF THE INVENTION

The present invention relates to a new and improved grinding method and apparatus and more specifically to an improved steadyrest which is used to support the workpiece during an initial grinding operation in which the workpiece is ground to a first size and during a second grinding operation during which the workpiece is ground to a second size which is smaller than the first size.

Automotive crankshafts having a plurality of crankpins have been ground to a desired size using grinding machines of the general type disclosed in U.S. Pat. Nos. 2,723,503; 2,780,895; and 3,006,118. When the crankpins have been ground, they are measured or gauged to determine if they are out-of-round. If one of the crankpins is out-of-round by an excessive amount, the crankshaft is rejected. However, if one of the crankpins is only slightly out-of-round, the crankshaft is transferred to a second grinding machine where all of the crankpins are ground undersize.

In accordance with known procedures, a crankshaft having an out-of-round crankpin is transferred from the first grinding machine to the second grinding machine to perform the undersize grinding. This is done in order to maintain the set up of the first grinding machine to perform the initial grinding operations on other crankshafts. If the first grinding machine was used to perform the undersize or secondary grinding operation, the set up on the machine would have to be changed from the set up used for the initial grinding operation to the set up used for the undersize or secondary grinding operation. The set up would subsequently have to be changed back to the set up used for the initial grinding operation.

During operation of grinding machines to perform the initial and undersize or secondary grinding operations, the crankpins are supported by steadyrests which may have a construction similar to that shown in U.S. Pat. Nos. 3,076,296 or 3,391,500. These steadyrests are set up to support the crankpin in a known manner during a grinding operation. If the size to which the crankpin is to be ground is changed, the steadyrest must be adjusted to enable it to be used with the different crankpin sizes. It should be noted that these known streadyrests are not easily adjusted between a condition in which they are set to support a crankpin during grinding to an initial size and then to support the same crankpin during grinding to a smaller size.

SUMMARY OF THE PRESENT INVENTION

The present invention provides a new and improved method and apparatus for grinding a workpiece and more specifically a method and apparatus for grinding crankshafts. During the grinding of a crankshaft with the improved apparatus, each of the crankpins is initially ground to a predetermined diameter. Each of the crankpins is measured to determine if it is out-of-round after the initial grinding operation. Assuming that a crankpin is out-of-round by an amount which is greater than the dimensional tolerances for the crankpin but less than an amount which may require scrapping of the crankshaft, a secondary grinding operation is undertaken after completion of the initial grinding operation. In accordance with a feature of the present invention, the initial and secondary grinding operations are performed with the same grinding machine without removing the crankshaft from the grinding machine.

To enable the same grinding machine to be used to perform both the initial and secondary or undersize grinding operations, an improved streadyrest assembly is easily adjusted to compensate for the smaller size to which the crankpins are ground during the secondary grinding operation. This improved steadyrest assembly can also be quickly and easily adjusted after performance of the secondary grinding operation to a condition in which it is set to support the pins of a next succeeding crankshaft during an initial grinding operation.

It is contemplated that a batch of undersize crankshafts may be inadvertently supplied for grinding. In order to prevent the grinding machine from performing secondary grinding operations on an excessive number of crankshafts, detectors are provided to effect initiation of a control function when the number of consecutive crankshafts and/or crankpins requiring secondary grinding operations is excessive.

Accordingly, it is an object of this invention to provide a new and improved method and apparatus for sequentially grinding the pins of a plurality of crankshafts and wherein a steadyrest is quickly and easily adjustable between an initial condition in which it is effective to support crankpins during grinding to initial size and a second condition in which the steadyrest is effective to support crankpins during grinding to a second size which is smaller than the initial size.

Another object of this invention is to provide a new and improved method of grinding crankshafts in which crankpins are ground to an initial size and then subsequently ground to a second size which is smaller than the initial size with the same grinding machine and without removing the crankshaft from the grinding machine.

Another object of this invention is to provide a new and improved apparatus for supporting a workpiece during an initial grinding operation and during a second grinding operation in which the workpiece is ground to a smaller size than during initial operation and wherein the apparatus includes a steadyrest member and a drive assembly for moving the steadyrest member relative to a base to compensate for the smaller size to which the workpiece is ground during the second grinding operation.

Another object of this invention is to provide an apparatus to detect when an excessive number of consecutive crankpins and/or crankshafts require secondary grinding operations.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
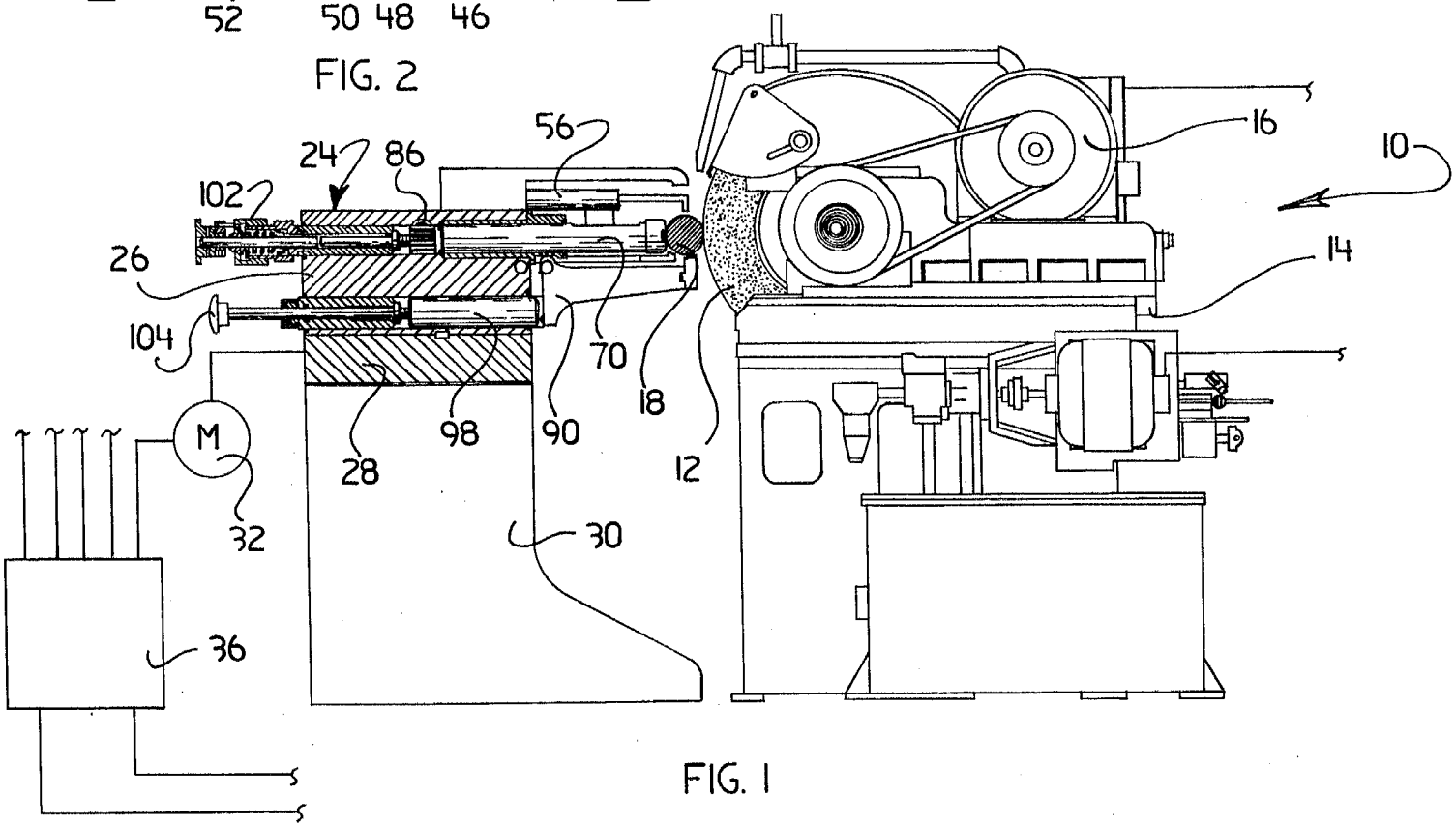
FIG. 1 an illustration of a grinding machine which is constructed and operated in accordance with the present invention.

An improved grinding machine 10 constructed in accordance with the present invention is illustrated in FIG. 1. The grinding machine 10 includes a grinding wheel 12 which is rotatably mounted on a wheel slide 14. During operation of the grinding machine 10, the grinding wheel 12 is rotated about its central axis by a grinding wheel drive motor 16 and the wheel slide 14 is moved toward a workpiece 18 by a wheel slide motor. As the workpiece 18 is being ground by the grinding wheel 12 in known manner, the workpiece is supported by a steadyrest assembly 24 constructed in accordance with the present invention.

The steadyrest assembly 24 includes a base 26 which is disposed on a slide or carriage 28. The slide or carriage 28 is movable relative to a support 30 by a motor 32 to move the steadyrest assembly 24 toward and away from the workpiece 18. The general manner in which the steadyrest assembly 24 is effective to support the workpiece 18 during a grinding operation is similar to that described in U.S. Pat. No. 3,076,296 and won't be described in detail herein in order to avoid complexity of description.

A controller 36 is provided to control the operation of the grinding machine 10. Although many different types of controllers can be utilized, in one specific instance the controller 36 was a programmable logic controller manufactured by Allen-Bradley Co., Inc. of Milwaukee, Wis., U.S.A. and designated as a P.L.C. 1774. A suitable up-down presettable counter was used in association with the Allen-Bradley programmable logic controller. It should be understood that operation of the grinding machine 10 could be effected by using known manual controls as well as by using known automatic control apparatus.

Although it is contemplated that the grinding machine 10 could be utilized to grind many different types of workpieces 18, the grinding machine is advantageously used to sequentially grind the pins of crankshafts. Thus, the workpiece 18 may be a crankshaft which is mounted in a pair of pot chucks 40 and 42 in the manner illustrated schematically in FIG. 2. Although the pot chucks 40 and 42 could have many different constructions, they are advantageously constructed in the manner shown in U.S. Pat. No. 2,780,895.

The pot chucks 40 and 42 rotate the crankshaft 18 about the central axis of a crankpin which is being ground by the wheel 12. Thus, when a first crankpin 46 (FIG. 2) is to be ground, the entire crankshaft 18 is rotated about the central axis of the crankpin 46. When a next succeeding crankpin 48 is to be ground, the crankshaft 18 and pot chucks 40 and 42 are moved axially toward the right (as viewed in FIG. 2) relative to the grinding wheel 12 to align the crankpin 48 with the grinding wheel. In addition, the crankshaft 18 is indexed in the pot chucks 40 and 42 so that the crankshaft is rotated about the central axis of the crankpin 48. The crankpins 50 and 52 are then ground in turn in the same manner as are the crankpins 46 and 48. Although the crankshaft 18 has only four crankpins, it is contemplated that the grinding machine 10 could be utilized to grind crankshafts having more or less than four pins.

Upon completion of grinding of each of the crankpins 46, 48, 50 and 52, a gauge assembly 56 (FIG. 1) is actuated to determine if the crankpin is out-of-round. Although it is preferred to perform the gauging step toward the end of the initial grinding operation and after the crankpin has been ground, it is contemplated that the measurement could be made during the grinding of the crankpin. Although many different types of gauge assemblies could be utilized, in one specific instance a Marposs "Mini-Pinvar" in process grinding gauge of the analog type was used. This gauge is manufactured by the Marposs Gauges Corporation of Madison Heights, Mich., U.S.A. However, it should be understood that other known types of gauges having shiftable control settings could be used if desired.

At the end of the first or initial grinding of each crankpin, the gauge assembly 56 checks the generally cylindrical surface 60 (see FIG. 3) of the crankpin to determine if the crankpin is out-of-round. The crankpin 46 has been illustrated in FIG. 3 as having an out-of-round condition which is greater than the maximum out-of-round condition allowed by the tolerances for the crankpin 46. The crankpin 46 is out-of-round to such an extent that the surface 60 extends through a cylindrical tolerance plane indicated by a dashed line 62 in FIG. 3. If the crankpin 46 was so far out-of-round that the outer surface 60 of the crankpin intersected a second cylindrical plane, indicated at 64 in FIG. 3, the crankshaft would be rejected. However, the surface 60 of the crankpin is only slightly out-of-round and can be corrected by an undersize or secondary grinding operation which is performed after all of the crankpins have been sequentially ground during an initial grinding operation. During the undersize or second grinding operation, the crankpins 46, 48, 50 and 52 are sequentially ground to a cylindrical undersize surface disposed in a plane indicated at 66 in FIG. 3.

Figure 3:
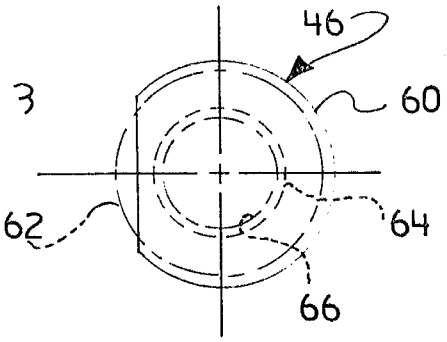
FIG. 3 is a schematic illustration depicting an out-of-round crankpin with the relationship between initial and undersize grinding dimensions being greatly exaggerated for purposes of clarity of illustration.

The spatial relationship of the planes 60, 62, 64 and 66 to each other has been greatly exaggerated in FIG. 3 to facilitate illustrating their general relationship to each other. Thus, in one specific instance, the radial tolerance distance between the cylindrical surface 60 and an imaginary cylindrical plane 62 was 0.00030". In this specific example, the cylindrical plane 64 indicating the maximum extent to which the crankpin can be out-of-round before it is rejected had a radius which is 0.0040" less than the radius of the cylindrical outer side surface 60. Finally, the undersize or secondary grind plane 66 to which the crankpin is ground during a secondary grinding operation had a radius which was 0.0050" less than the radius of the cylindrical surface 60. It should be understood that the foregoing radial distances will vary depending upon the particular crankshaft being ground. The dimensions have been set forth herein only for purposes of illustration and is not intended that the invention should be limited to any particular dimensional tolerances or a range of tolerances.

Both the initial grinding operation and the secondary or undersize grinding operation are completed before the crankshaft 18 is removed from the grinding machine 10. Once the crankshaft 18 is mounted in the grinding machine 10, it is not removed from the grinding machine until after the crankpins 46, 48, 50 and 52 have been completely ground. After the crankshaft 18 has been ground and removed from the grinding machine 10, a next succeeding crankshaft is mounted in the grinding machine.

Steadyrest Assembly

The steadyrest assembly 24 is used to support each of the crankpins in turn during both the initial grinding operation during which the crankpins are ground to a relatively large initial diameter and a secondary grinding operation during which the crankpins are ground to a relatively small diameter. The steadyrest assembly 24 includes a steadyrest member or bar 70 (see FIGS. 4 and 5) having an outer end portion or shoe 72 with a support surface 74 which engages the cylindrical outer surface 60 of the crankpin 46 to prevent the crankpin from being deflected under the influence of forces applied against the crankpin by the grinding wheel 12 (see FIG. 1). The steadyrest bar 70 is slidably supported on the base 26 and is movable with the base 26 from a retracted position spaced a substantial distance from the crankshaft to an operating position adjacent a crankpin upon movement of the slide 28 under the influence of the motor 32 (FIG. 1). This enables the steadyrest assembly 24 to be moved out of the way during loading, indexing and unloading of the crankshaft 18 from the grinding machine.

Figure 2:
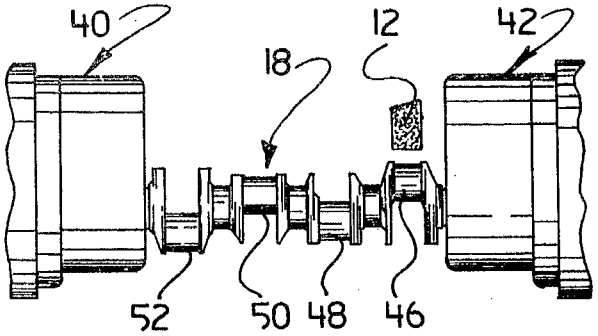
FIG. 2 is an illustration depicting the manner in which a crankshaft is mounted in the grinding machine of FIG. 1 during a grinding operation.

When a crankshaft 18 has been mounted in the grinding machine in the manner illustrated schematically in FIG. 2, a sparking operation is performed. During the sparking operation, the steadyrest bar 70 (FIG. 5) is rotated about its central axis to engage shoulders at opposite sides of the crankpin to center the crankpin relative to the grinding wheel 12. The steadyrest member 70 is rotated about its central axis by movement of a rack gear 80. The rack gear 80 rotates a pinion gear 82 which is fixedly connected with the steadyrest bar 70. The rack gear 80 is disposed on the underside of a longitudinally extending and generally cylindrical piston 86 (see FIGS. 5 and 6). Upon axial movement of the piston 86 upwardly (as viewed in FIG. 6) the steadyrest bar 70 is rotated about its central axis to locate the crankshaft 18 relative to the released pot chucks 40 and 42 in a manner similar to that described in U.S. Pat. No. 3,076,296. Once the crankshaft 18 has been located axially relative to the pot chucks 40 and 42, the pot chucks are closed and the crankshaft is rotated about the central axis of the crankpin 46.

A second or lower streadyrest bar 90 (FIG. 5) is pivotally connected with the base 26 and has an end portion or shoe 92 with a support surface 94 which is pressed against a lower portion of the crankpin 46. The steadyrest member 90 is pivoted about connection 96 to the base 26 by linear movement of a member 98. Suitable adjustment assemblies 102 and 104 are provided in association with the steadyrest members 70 and 90 to enable their initial positions to be adjusted in a known manner.

Figure 4:
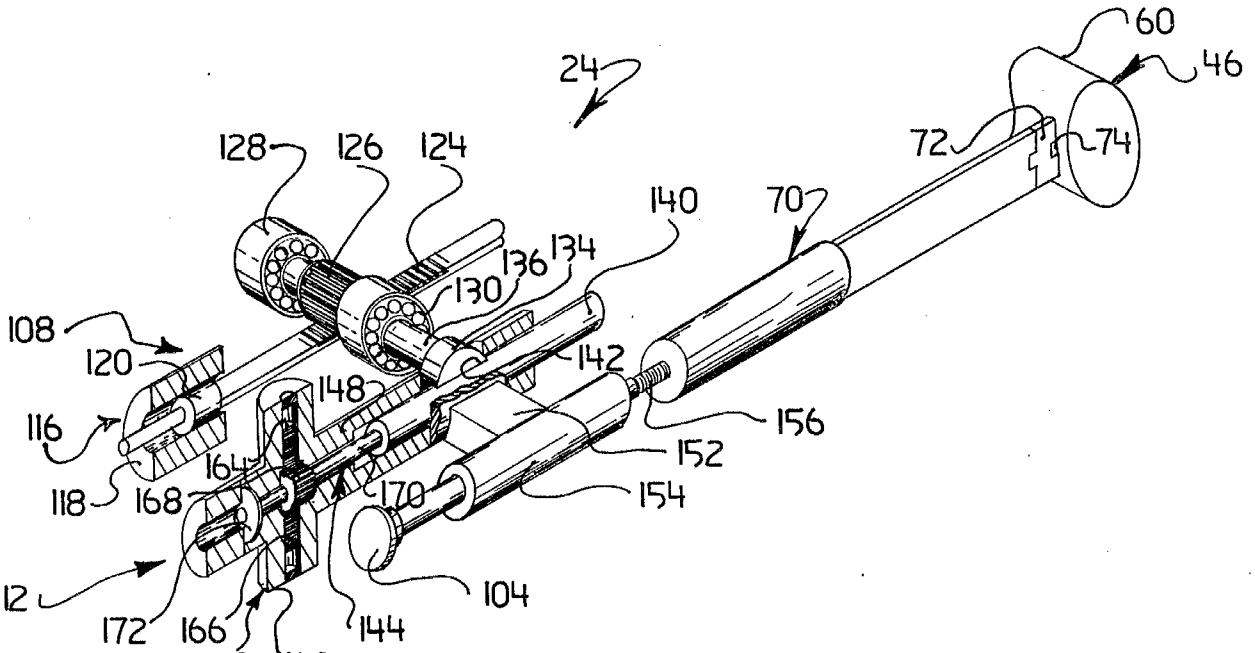
FIG. 4 is a schematic illustration depicting a portion of a steadyrest assembly construction in accordance with the present invention and used in association with the grinding machine of FIG. 1.
Figure 6:
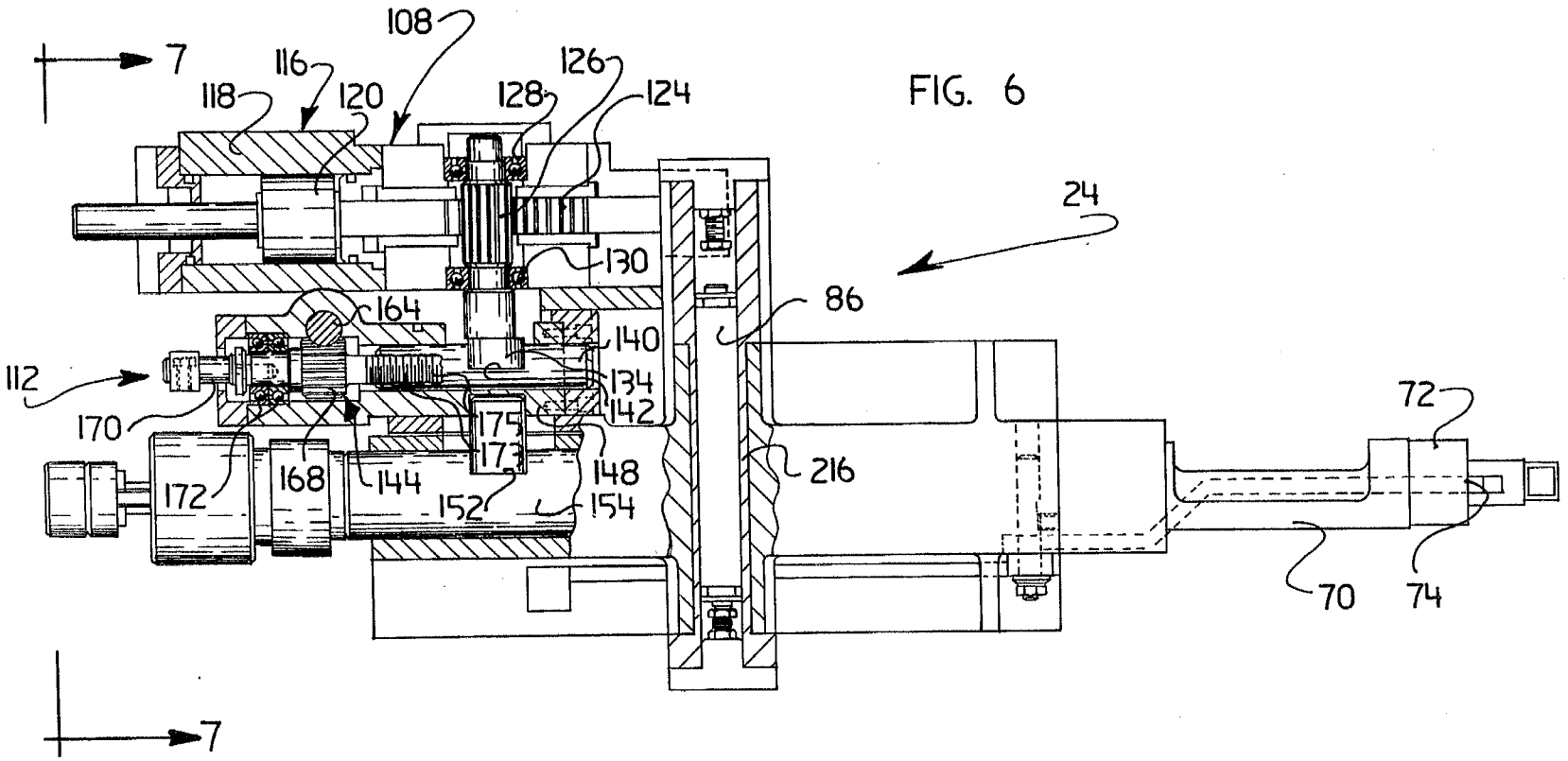
FIG. 6 is a fragmentary sectional view taken generally along the line 6—6 of FIG. 5 and further illustrating the construction of the steadyrest assembly.

During a grinding operation, the steadyrest member 70 is moved into engagement with the crankpin 46 under the influence of a main drive assembly 108 (see FIGS. 4 and 6). The main steadyrest drive assembly 108 is effective to move the steadyrest member 70 axially relative to the base 26. This movement presses the support surface 74 on the steadyrest member 70 against the crankpin 46 after the base 26 has been moved from its retracted position to its operating position by operation of the steadyrest slide motor 32. During the initial grinding operation, the main steadyrest drive assembly 108 holds the support surface 74 on the outer end of the steadyrest member 70 against the crankpin 46 to prevent deflection of the crankshaft 18 under the influence of the grinding wheel 12.

If during an initial grinding operation it is determined that at least one of the crankpins is out-of-round by an amount which is greater than the tolerance range for a finished crankpin and less than the amount which requires scrapping of the crankshaft, a secondary grinding operation is undertaken after the initial grinding operation has been completed. When this is to happen, a secondary steadyrest drive assembly 112 (see FIGS. 4 and 6) is actuated between grinding operations to adjust the reference position of the steadyrest member 70. This adjustment compensates for the relatively small size to which the crankpin 46 is ground during the secondary grinding operation. Thus, operation of the secondary drive assembly 112 is effective extend the steadyrest member 70 toward the crankpin 46 through a distance equal to the radial distance by which the outer surface 60 of the crankpin is to be ground during the secondary grinding operation.

In the example previously set forth, the crankpin is ground down through a radial distance of 0.0050" during the secondary grinding operation. Therefore, in this case the secondary drive assembly 112 is operated to move the steadyrest member 70 relative to the base 26 from an initial reference position through an axial distance of 0.0050" toward the crankshaft 18 to a second reference position.

The steadyrest member 70 is moved from the second reference position by the main drive assembly 108 during the secondary grinding operation. During the secondary grinding operation, the main drive assembly 108 moves the steadyrest member 70 in the same manner as during the initial grinding operation. By utilizing the secondary drive assembly 112 to shift the reference position from which the steadyrest member 70 is moved by the main drive assembly 108 during the secondary grinding operation, the set up for the main drive assembly does not have to be changed to perform the secondary grinding operation upon completion of the initial grinding operation.

Main Drive Assembly

The main drive assembly 108 is utilized to move the steadyrest member 70 into and out of engagement with the crankpins 46, 48, 50, and 52 during both the initial and secondary grinding operations. The main drive assembly 108 (see FIGS. 4 and 6) includes a main drive motor 116 having a cylinder 118 in which a cylindrical piston 120 is disposed. A longitudinally extending rack gear 124 is fixedly connected with the piston 120 and is disposed in meshing engagement with a pinion gear 126 which is rotatably supported by bearings 128 and 130. A cam member 134 is fixedly connected with one end of a shaft 136 which extends axially outwardly from the pinion gear 126 and is integrally formed with the pinion gear.

Figure 5:
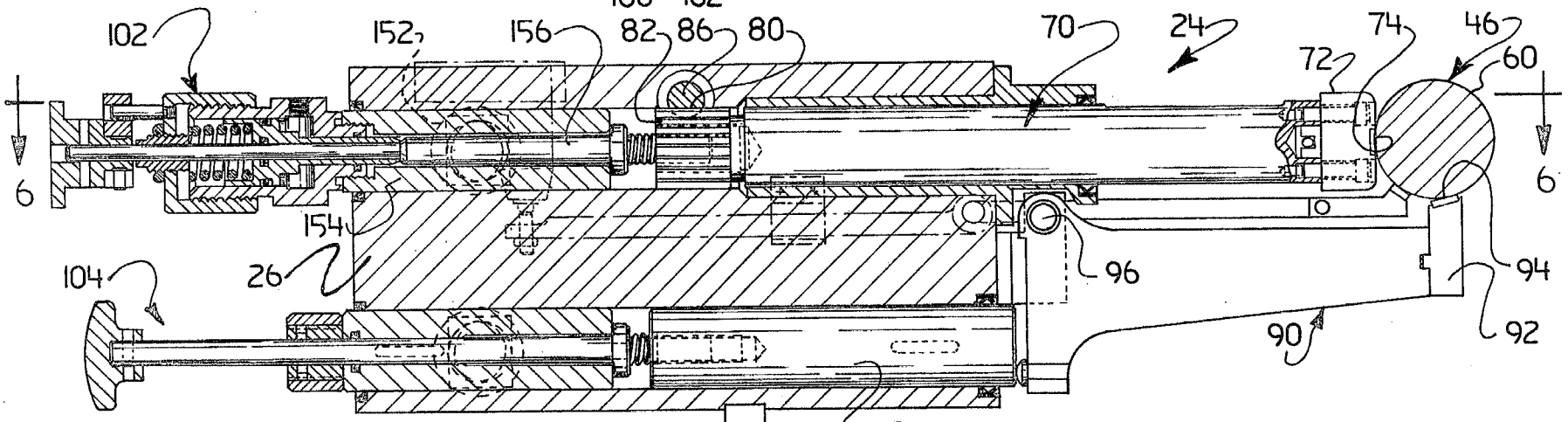
FIG. 5 is an enlarged sectional view of a steadyrest assembly constructed in accordance with the present invention and illustrating the manner in which a workpiece is supported by the steadyrest assembly during a grinding operation.

Upon rotation of the pinion gear 126 and cam member 134, the cam member 134 effects axial movement of a cylindrical drive member or cam bar 140 having a rectangular recess 142 in which the circular cam 134 is received. At this time, a force transmitting assembly 144 is effective to hold the drive member 140 against axial sliding movement relative to a cylindrical drive member 148 in which the drive member 140 is disposed. The cylindrical drive member 148 is connected with the steadyrest member 70 by a drive block 152 which is connected with a bar 154. The bar 154 is connected with the steadyrest member 70 by a threaded member 156 (FIGS. 4 and 5). The threaded connection between the bar 154 and steadyrest member 70 enables the steadyrest member to be rotated by the rack gear 80 (FIG. 5) during a sparking operation.

When the steadyrest member 70 is to be moved into engagement with the crankpin 46 during either an initial or secondary grinding operation, the motor 116 is actuated to move the rack gear 124 axially toward the left (as viewed in FIGS. 4 and 6). This results in rotation of the cam member 134 to move the drive member 140 toward the crankshaft, that is toward the right as viewed in FIGS. 4 and 6. This rightward movement of the drive member 140 is transmitted through the assembly 144 to the outer drive member 148. The outer drive member 148 is connected with the steadyrest member 70 and is effective to move the steadyrest member toward the right (as viewed in FIGS. 4 and 6) to press the support surface 74 on the outer end portion 72 of the steadyrest member 70 firmly against the crankpin 46.

Secondary Drive Assembly

The secondary drive assembly 112 is provided to compensate for the relatively small diameter to which the crankpin 46 is ground during a secondary grinding operation. To accomplish this, the secondary drive assembly is effective to shift the reference position from which the steadyrest member 70 is moved by the main drive assembly 108. To shift the steadyrest reference position toward the crankshaft 18, the secondary drive assembly 112 actuates the force transmitting assembly 144 to slide the outer drive member 148 toward the right (as viewed in FIGS. 4 and 6) relative to the inner drive member 140. This causes the drive block 152 to move the steadyrest member 70 toward the right from a first reference position which is used during the initial grinding operation to a second reference position which is used during the secondary grinding operation.

Figure 7:
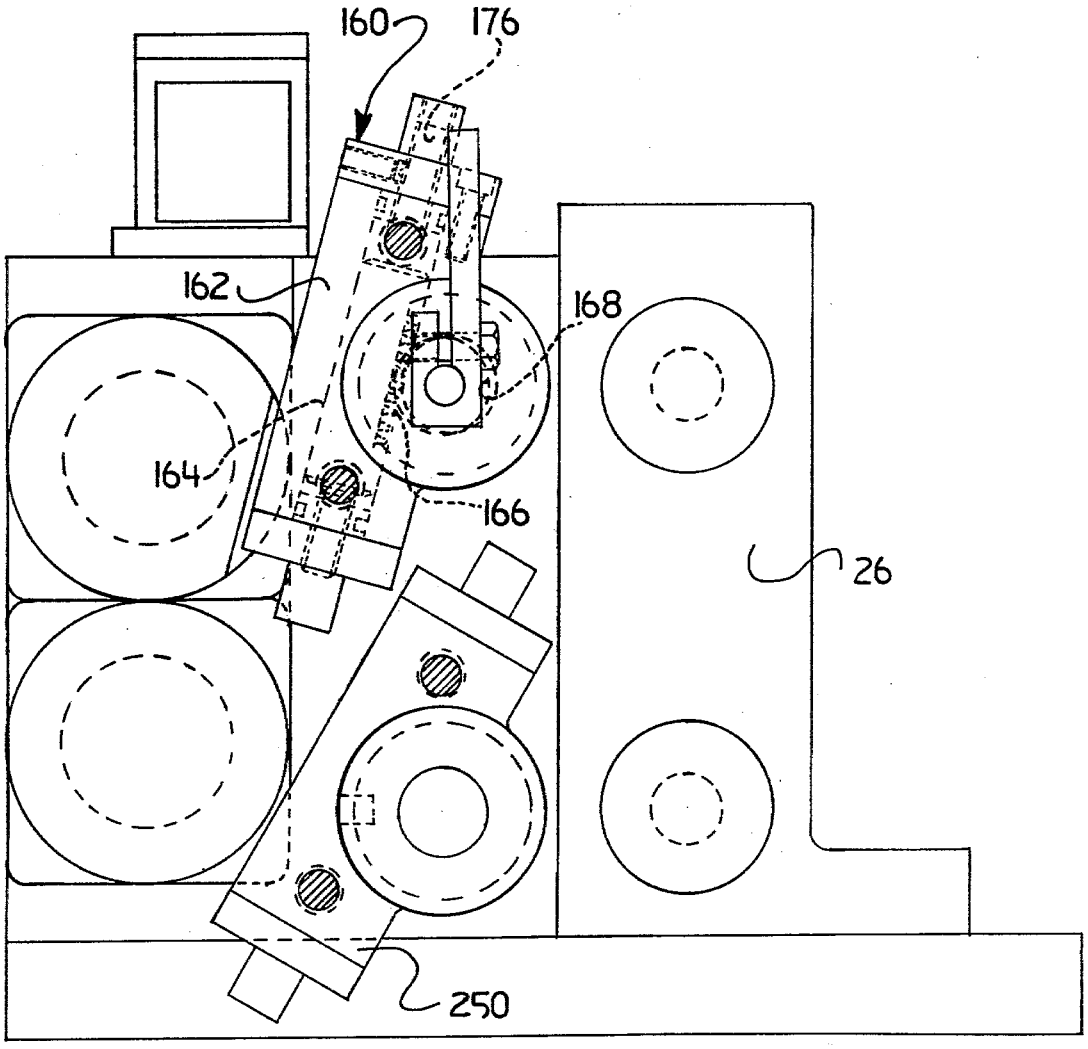
FIG. 7 is an enlarged end view taken generally along the line 7—7 of FIG. 6 and illustrating the relationship between a pair of motors which are used to adjust the streadyrest assembly upon changing between an initial grinding operation and a secondary or undersize grinding operation.

The secondary drive assembly 112 includes a motor 160 (FIGS. 4 and 7) having a cylinder 162 in which a piston 164 is disposed. Rack gear teeth 166 formed on the piston 164 are disposed in meshing engagement with a pinion gear 168 (FIGS. 4 and 6). The pinion gear 168 is integrally formed with a rotatable drive member 170 in the force transmitting assembly 144. The drive member 170 is rotatably connected with the drive member 148 by suitable bearings 172. The opposite end of the drive member 170 is connected with the drive member 140 by external screw threads 173 formed on the drive member 170 and internal threads 175 formed in a cavity inside the drive member 140 (FIG. 6).

When the drive assembly 112 is to be operated upon completing an initial grinding operation and before undertaking the secondary grinding operation to compensate for the relatively small size to which the crankpin is to be ground during the secondary grinding operation, high pressure fluid is ported to the lower end (as viewed in FIGS. 4 and 7) of the motor cylinder 162. This causes the piston 164 to move upwardly (as viewed in FIGS. 4 and 7). As the piston 164 moves upwardly, the rack gear teeth 166 are effective to rotate the pinion gear 168 (FIG. 6). Rotation of the pinion gear 168 causes the drive member 170 to move toward the right (as viewed in FIG. 6) under the influence of the threaded connection between the end portion of the shaft 170 and the drive member 140. At this time, the drive member 140 is held against axial movement by the cam 134 and the inactive motor 116 in the main drive assembly 108. Therefore, the cylindrical drive member 148 is moved axially toward the right relative to the drive member 140.

The movement of the drive member 148 toward the crankshaft 18 is transmitted to the steadyrest member 70 through the drive block 152 and member 154. This movement of the steadyrest member 70 shifts its reference position toward the crankshaft. It should be noted that the motor cylinder 162 is connected with the drive member 148 and moves toward the right (as viewed in FIGS. 4 and 6) with the drive member 148 under the influence of force transmitted through the threaded connection between the stationary drive member 140 and the force transmitting shaft 170.

The distance through which the steadyrest member 70 is moved by the secondary drive assembly 112 corresponds to the radial distance by which the diameter of the crankpin is to be reduced during the secondary grinding operation. In the example previously set forth, the drive member 148 would be slid through a distance of 0.0050" relative to the stationary drive member 140. This shifts the position of the steadyrest bar 70 toward the crankpin 46 through the radial distance which the crankpin is to be ground down during the secondary grinding operation. In order to enable this radial distance to be adjusted, an adjustable stop member 176 (see FIG. 7) is provided in association with the motor 160 to enable the stroke of the piston 164 to be adjusted. Of course, adjusting the stroke of the piston 164 adjusts the extent to which the pinion gear 168 (FIG. 6) is rotated and the extent to which the threaded connection between the force transmitting shaft 170 and the drive member 140 is effective to move the drive member 148.

Once the position of the steadyrest member 70 has been adjusted relative to the base 26 by operation of the secondary drive assembly 112, the main drive assembly 108 is operated during the secondary grinding operation in the same manner as during the initial grinding operation. However, since the reference position from which the steadyrest member 70 is moved by the main drive assembly 108 has been shifted toward the workpiece through a distance corresponding to the radial amount which is to be removed from the crankpin during the secondary grinding operation, the steadyrest member is effective to support the crankpin during the secondary grinding operation.

Once the secondary grinding operation has been completed and the main drive assembly 116 has been operated to retract the steadyrest member 70, the secondary drive assembly 112 is actuated to move the steadyrest member back to its initial reference position. Thus, the piston 164 in the motor 160 is moved downwardly (as viewed in FIG. 7). The force transmitting shaft 170 rotates to cause the threaded connection between the stationary drive member 140 and the force transmitting shaft to slide the cylindrical outer drive member 148 toward the left (as viewed in FIG. 6) relative to the stationary inner drive member 140. This results in movement of the steadyrest member 70 back to its initial position. It should be noted that during operation of the secondary drive assembly 112, the main drive motor 116 is inactive to hold the cam member 134 against rotation to thereby prevent axial movement of the drive member 140. This enables the drive member 148 and the secondary drive motor 160 to be moved together relative to the base 26 and the stationary drive member 140.

Although only the main and secondary drive assemblies 108 and 112 for the upper steadyrest member 70 have been fully described herein, it should be understood that similarly constructed main and secondary drive assemblies are provided to effect movement of the lower steadyrest member 90 in which the same manner is previously described with the upper steadyrest member 70. It should be understood however, that the main and secondary drive assemblies associated with the lower steadyrest member 90 are effective to move the drive bar 98 (see FIG. 5) to effect pivotal movement of the lower steadyrest member 90 about the connection 96.

Control Circuitry

Figure 8:
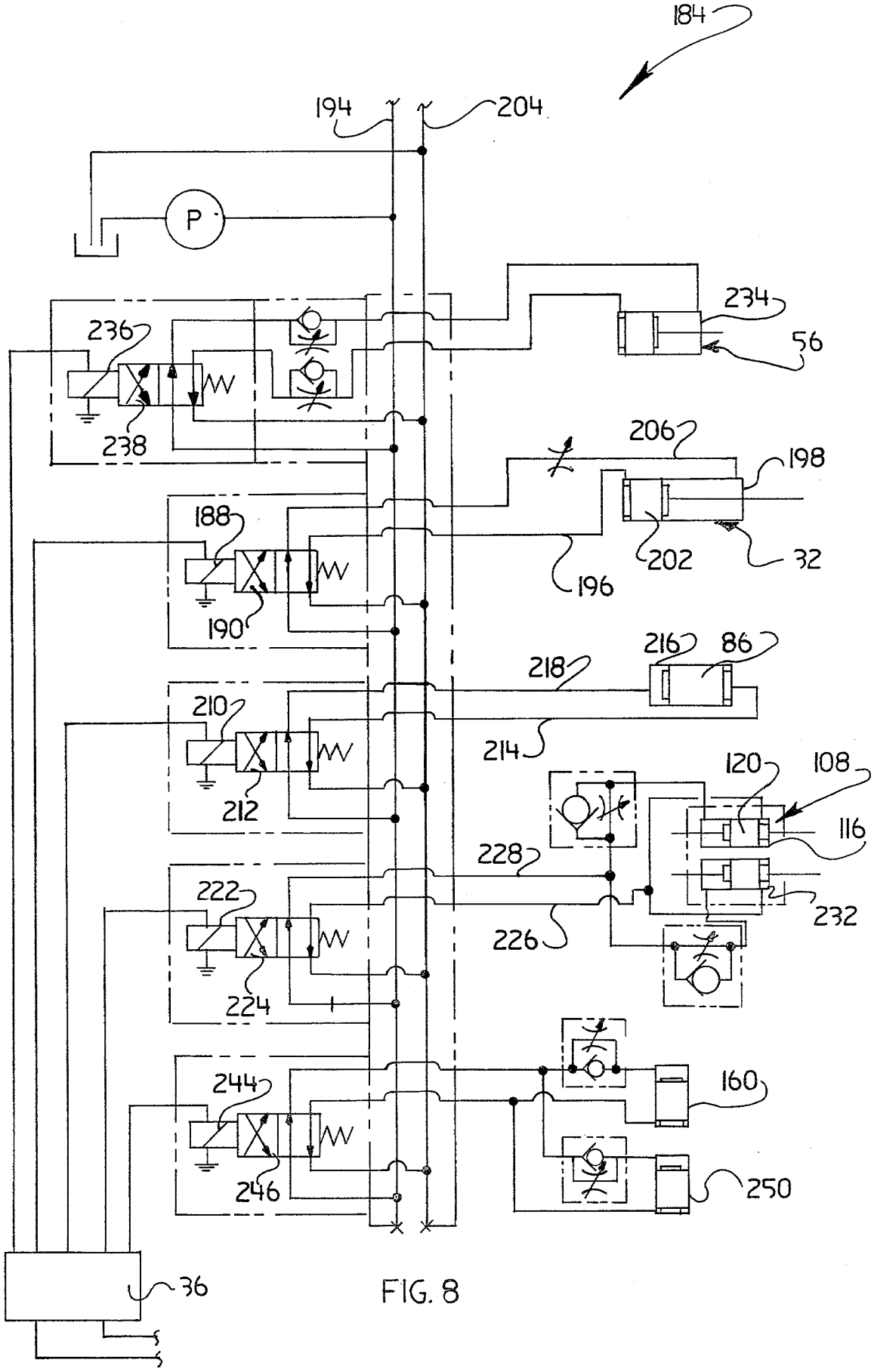
FIG. 8 is a schematic illustration depicting the construction of control circuitry used in association with the grinding machine of FIG. 1.

Hydraulic control circuitry 184 for controlling the operation of the steadyrest assembly 24 and the gauge 56 is illustrated schematically in FIG. 8. The hydraulic control circuitry 184 is activated under the influence of the controller 36 to perform the initial and secondary grinding operations.

When an initial grinding operation is to be started, the controller 36 actuates the drive motor 32 (FIGS. 1 and 8) to move the steadyrest base or slide 28 toward the crankshaft 18. To this end, the controller 36 effects energization of the solenoid 188 (FIG. 8) to actuate a valve 190 to port fluid under pressure from a supply line 194 to a conduit 196 leading to one end of a motor cylinder 198. This high pressure fluid causes a piston 202 in the slide motor 32 to move the steadyrest base or slide 26 (FIG. 1) from a retracted position in which it is clear of the crankshaft to an operating position in which it is closely adjacent to the crankshaft. During movement of the piston 202 (FIG. 8) in the cylinder 198, fluid is conducted to a drain conduit 204 through a conduit 206.

When the steadyrest assembly 24 has been moved to its operating position by operation of the motor 32, a sparking operation is undertaken to axially locate the crankshaft 18 relative to the grinding wheel 12. Thus, the controller 36 energizes a solenoid 210 (FIG. 8) to actuate a valve 212 to port fluid under pressure to a conduit 214 leading to a motor cylinder 216 in which the piston 86 (see FIGS. 6 and 8) is disposed. The piston 86 is moved toward the left (as viewed in FIG. 8) or upwardly (as viewed in FIG. 6) to effect rotation of the steadyrest member 70 to axially position the crankshaft in the manner previously explained. The solenoid 210 is then deenergized and the valve 212 is effective to port fluid under pressure through a conduit 218 to effect rotation of the steadyrest member 70 back to its original position.

Part way through the initial grinding operation, main drive assemblies are actuated to press the support surfaces 74 and 94 on the upper and lower steadyrest members 70 and 90 against the crankpin 46. To accomplish this, the controller 36 energizes a solenoid 222 to actuate a valve 224 to port high pressure fluid to a conduit 226 and connect a conduit 228 with a drain conduit 204. This high pressure fluid is connected to the right end (as viewed in FIGS. 6 and 8) of the motor 116 to cause the piston 120 to be moved to the left (as viewed in FIGS. 6 and 8) to rotate the cam member 134 and to move the drive member 140 toward the right (as viewed in FIG. 6). This rightward movement of the drive member 140 is transmitted to the steadyrest member 70 through the force transmitting assembly 144 and the drive member 148 to move the steadyrest member from a retracted position to a position in which the support surface 74 on the steadyrest member 70 is pressed against the crankpin 46. At the same time, a second main drive motor 232 (FIG. 8) is operated to move the lower steadyrest member 90 (FIG. 5) upwardly against the crankpin 46 simultaneously with movement of the upper support member 70 against the crankpin.

Upon completion of initial grinding operation, the controller 36 deenergizes the solenoid 222 to effect operation of a valve 224 to the position shown in FIG. 8. This results in the main drive assemblies being operated to retract the steadyrest members 70 and 90.

Immediately before the steadyrest members 70 and 90 are retracted, a gauge drive motor 234 (FIG. 8) is actuated to cause the gauge assembly 56 (FIG. 1) to check the crankpin 46 to determine if it is out-of-round. Thus, the controller 36 energizes a solenoid 236 to actuate a valve 238 to port high pressure fluid to the left (as viewed in FIG. 8) end of the motor 234. When the gauging operation has been completed, the solenoid 236 is deenergized and the valve 238 returns the initial condition shown in FIG. 8 to return the gauge assembly 56 to its inactive position. Of course the gauge assembly 56 could be used in the performance of other machine operating functions if desired.

If the gauging operation determines that the crankpin 46 is out-of-round to an extent greater than allowed by the tolerances for the surface 60 but less than an extent which would require rejecting of the crankshaft, a secondary grinding operation is undertaken to effect an undersize grinding of the crankpins after all of the crankpins have been subjected to an initial grinding operation. Before the secondary grinding operation is initiated, secondary drive assemblies for the upper and lower steadyrest members 70 and 90 are actuated to change the reference positions of the steadyrest members 70 and 90.

To effect operation of the secondary drive assemblies, the controller 36 energizes a solenoid 244 (FIG. 8) to actuate a valve 246. Actuation of the valve 246 ports high pressure fluid to the secondary drive motor 160 (FIGS. 7 and 8) for the upper steadyrest member 70. At the same time, a secondary drive motor 250 (FIGS. 7 and 8) for the lower steadyrest member is actuated.

Actuation of the motors 160 and 250 causes the steadyrest members 70 and 90 to be actuated from initial reference positions to secondary reference positions.

The secondary reference positions are displaced from the initial reference position by distance equal to the radial distance which the crankpin is to be ground down during the secondary grinding operation. Thus in the example previously set forth, the motor 160 would be operated to move the steadyrest member 70 through an axial distance of 0.0050". Due to the leverage obtained by the pivotal mounting of the lower steadyrest member 90, the motor 250 is actuated to move the lower steadyrest member 90 through a distance which is different than the distance by which the radial dimension of the crankpin is to be reduced during the secondary grinding operation. The motors 116 and 132 in the main drive assemblies for the steadyrest members 70 and 90 are then effective to move the steadyrest members 70 and 90 from their secondary reference positions during the undersize grinding operation to thereby compensate for the relatively small size to which the crankpin is to be ground during the secondary grinding operation.

Figure 9:
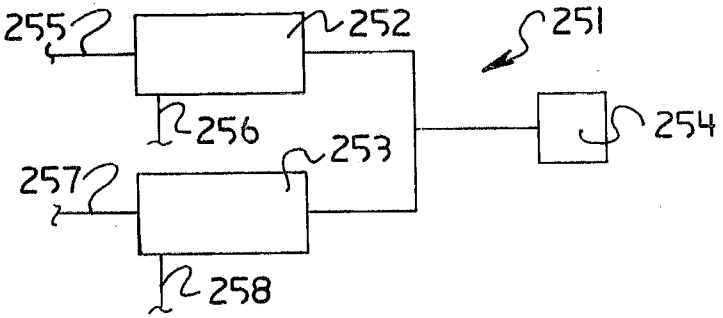
FIG. 9 is a schematic illustration of additional control circuitry used in association with the grinding machine of FIG. 1.

It is contemplated that during operation of the grinding machine 10 it may be desirable to interrupt operation of the grinding machine if an excessively large number of crankshafts have crankpins which are out-of-round. In addition, it is contemplated that it may be desirable to interrupt operation of the grinding machine 10 if an excessively large number of consecutive crankpins are out-of-round. To this end, a control circuit 251 (FIG. 9) is provided.

The control circuit 251 includes a presettable counter 252 which is utilized to detect when the number of consecutive out-of-round crankpins exceeds a predetermined number. A second presettable counter 253 is utilized to detect when the number of crankshafts having one or more crankpins which are out-of-round exceeds a predetermined number. When the number of out-of-round crankpins and/or crankshafts is excessive, an output signal from the counters 252 and/or 253 activates control circuitry 254 to initiate a suitable control function. In one specific instance, the control circuit 254 was utilized to shut down the grinding machine 10 and to energize an alarm light. Of course, the control circuit 251 could be used to detect only the number of out-of-round crankshafts or only the number of out-of-round crankpins.

Each time it is necessary to provide a secondary grinding operation to compensate for an out-of-round crankpin, an input signal is transmitted over a lead 255 to the counter 252. When the count in the counter 252 reaches a predetermined value, a signal is provided to the control circuitry 254. However, each time a crankpin does not require a secondary grinding operation, a signal is provided over a lead 256 to reset the counter 252 back to zero. Therefore, the counter 252 is effective to count only the number of consecutive crankpins which are out-of-round.

The counter 253 is provided with an input signal over a lead 257 each time a secondary grinding operation is undertaken for one of the pins of a crankshaft. However, the input to the counter 253 is disabled after the first secondary grinding operation is undertaken for a particular crankshaft so that if subsequent crankpins are found to be out-of-round to such an extent that a secondary grinding operation is necessary for a particular crankshaft, the count stored in the counter 253 remains constant. When a crankshaft does not have any crankpins which are out-of-round in extent requiring a secondary grinding operation, a signal is provided over a lead 258 to reset the counter 253. Therefore, the counter 253 is effective to count the number of consecutive crankshafts having crankpins which are out-of-round to such an extent as to require a secondary grinding operation. When the number of consecutive crankshafts requiring a secondary grinding operation exceeds a predetermined number to which the counter 253 is set, an output signal from the counter 253 initiates operation of control circuitry 254 in the manner previously described.

Operating Cycle

Figure 10:
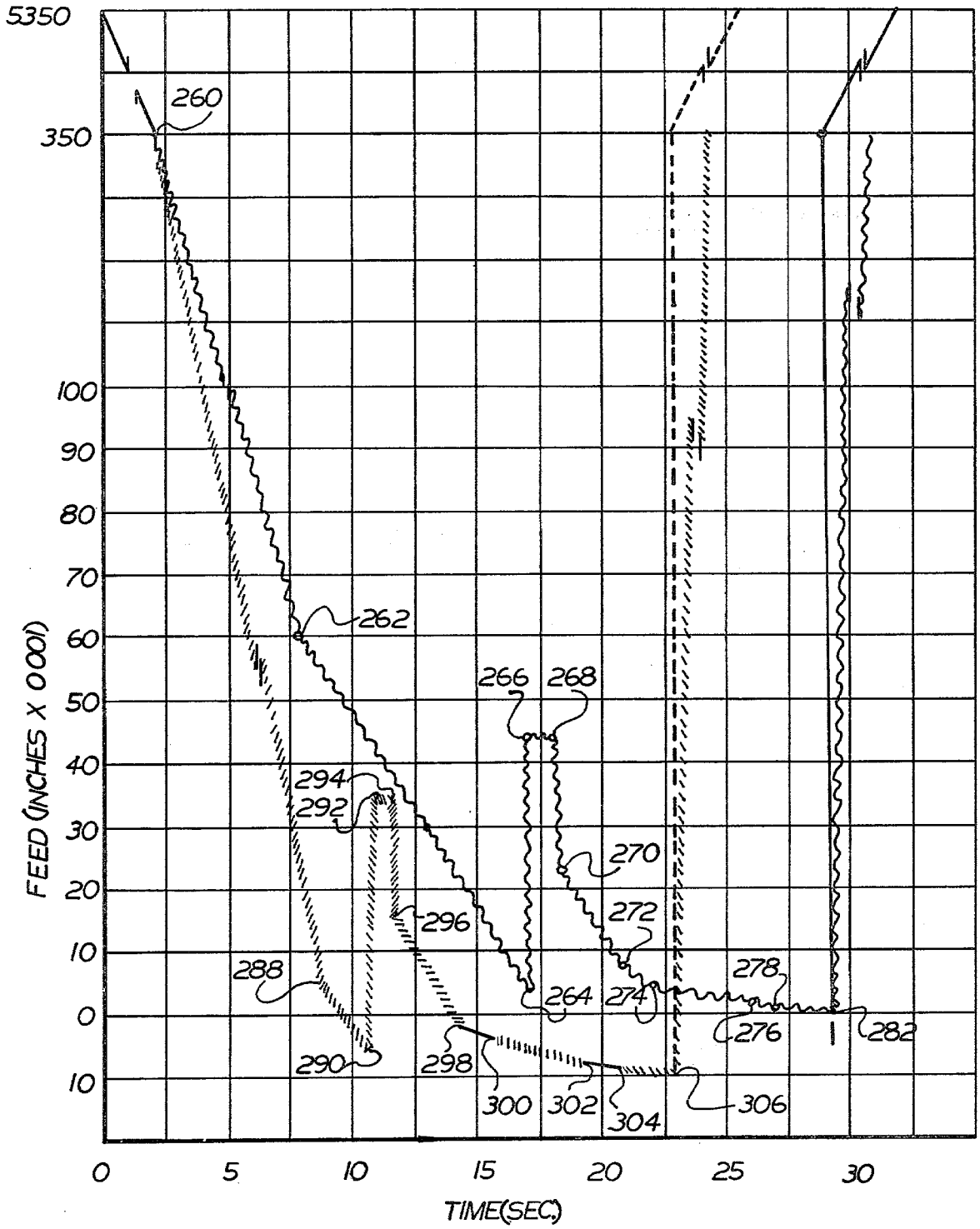
FIG. 10 is a graph depicting an initial grinding operation and a secondary or undersize grinding operation.

An initial grinding operation and a secondary grinding operation have been depicted graphically in FIG. 10. Upon initiation of a grinding operation, the crankshaft 18 is mounted in the pot chucks 40 and 42. The crankshaft is indexed so that the pot chucks 40 and 42 are effective to rotate the crankshaft about the central axis of the first crankpin 46. A spark-splitting operation is then peformed with the steadyrest assembly 24 to locate the crankshaft 18 axially.

Once the crankshaft has been mounted and located in this manner, the wheel slide motor is energized to move the grinding wheel 12 through a rapid traverse stroke toward the crankshaft 18 while the grinding wheel is being rotated by the motors 16. The end of the rapid tranverse stroke is indicated at the point 260 in FIG. 10. The controller 36 then reduces the speed of operation of the wheel slide motor 20 to effect a shoulder feed rate until the point 262 (see FIG. 10) is reached. A somewhat slower body feed rate is then undertaken and until the grinding wheel 12 is at the point indicated by the numeral 264 in FIG. 10. At this time, the steadyrest assembly 24 has been moved to the operating position by the steadyrest slide motor 32. However, the steadyrest members 70 and 90 are retracted.

When the point in the operating cycle indicated by the numeral 264 in FIG. 10 is reached during the initial grinding operation, the main steadyrest motors 116 and 232 are activated to initiate movement of the steadyrest members 70 and 90 toward the crankpin 46. At the same time, the grinding wheel 12 is retracted from the point indicated at 264 in FIG. 10 to the point indicated at 266 in FIG. 10. The grinding wheel 12 remains spaced from the workpiece until the steadyrest support surfaces 74 and 94 are pressed firmly against the crankpin 46. This has occurred by the point indicated by the numeral 268 in FIG. 10. It is contemplated that it may be desirable to activate the steadyrest motors 116 and 232 when the point 266 is reached rather than at the point indicated at 264 in FIG. 10.

The grinding wheel is then rapidly advanced until the point indicated by the numeral 270 (FIG. 10) is reached. A second body feed of the grinding wheel 12 is then initiated until a gauge point 272 is reached. The grinding wheel is then advanced at a slow rate until the point 274 is reached. As the grinding wheel is moved between the points 272 and 274, the motor 234 is operated to cause the gauge assembly 56 to check the crankpin 46. If the gauge assembly 56 determines that the crankpin 46 is out-of-round by a radial distance which is more than a predetermined maximum amount, the grinding operation is stopped and the workpiece is rejected since it is so far out-of-round that it cannot be finished with an undersize or secondary grinding operation.

Assuming that the crankshaft does not have to be rejected, a fine feed is then initiated from the point represented by the numeral 274 in FIG. 10 to the point represented by the numeral 276. The grinding wheel 12 then dwells and a second engaging operation is undertaken when the point 278 is reached. It should be noted that although the grinding wheel is dwelling, material is being removed at a very slow rate from the workpiece.

In this second gauging operation shows that the crankpin is out-of-round by more than the predetermined minimum amount which is less than a predetermined maximum amount, a secondary grinding operation will be undertaken after an initial grinding operation has been performed on all of the crankpins. In the illustration previously set forth, the secondary grinding operation was undertaken if the crankpin was out-of-round by a radial distance of more than 0.00030" and by an amount which was less than 0.0040". Of course, the specific distances will vary depending upon the dimensional tolerances associated with a particular workpiece.

Assuming that the crankpin 46 is out-of-round by an amount which is greater than dimensional tolerances for the crankpin and less than an amount which may dictate scrapping the crankshaft, the initial grinding operation is completed with a sparking out to the point indicated by the numeral 282 in FIG. 10. The grinding wheel 12 is then retracted and the main drive motors 116 and 232 are activated to retract the steadyrest members 70 and 90.

The pot chucks 40 and 42 are then released and the crankshaft 18 is moved axially to align the next succeeding crankpin 48 with the grinding wheel 12. The crankshaft is then indexed so that the pot chucks 40 and 42 are effective to rotate the crankshaft about the central axis of the next succeeding crankpin 48. An initial grinding operation is then performed on the crankpin 48 in the manner previously explained in connection with the crankpin 46.

After initial grinding operations have been performed on all of the crankpins 46, 48, 50 and 52, a secondary grinding operation is undertaken since the crankpin 46 was assumed to be out-of-around by an amount which requires the undersize grinding operation. Before initiating the secondary grinding operation, the secondary steadyrest drive motors 160 and 250 (FIGS. 7 and 8) are activated to move the steadyrest members 70 and 90 (FIG. 5) to change their reference positions by 0.005". This is because during the secondary grinding operation the crankpins are ground to a radius which is 0.005" less than the radius to which they were ground during the initial grinding operation.

Once the secondary drives 160 and 250 have been actuated to change the reference positions of the steadyrest members 70 and 90, the grinding machine 10 is operated through a secondary grinding operation which is the same as the initial grinding operation with the exception that the diameter to which the crankpins are ground is reduced. Thus, after the steadyrest members 70 and 90 have been adjusted by operation of the secondary motors 160 and 250, the secondary grinding operation is undertaken by moving the grinding wheel 12 from the point indicated at 260 in FIG. 10 to the point indicated at 288 in FIG. 10. It should be noted that the relatively high speed shoulder feed is maintained for a longer time during the secondary grinding operation since the crankpin surfaces have been ground during the initial grinding operation.

A body feed is undertaken from the point indicated at 288 to the point indicated at 290 in FIG. 10. Upon reaching the point indicated at 290 in FIG. 10, the main steadyrest drive motors 116 and 132 are activated to initiate movement of the steadyrest members 70 and 90 from their adjusted reference positions to their extended positions. As this is occurring, the grinding wheel 12 is retracted to the point indicated at 292 in FIG. 10. When the steadyrest members 70 and 90 have been fully extended, the point indicated at 294 in the secondary grinding operation will have been reached.

The grinding wheel 12 is then moved from the point indicated at 294 in FIG. 10 to the point indicated by the numeral 296 in FIG. 10. A body feed is then undertaken to the point indicated at 298 in FIG. 10. During a dwell between the point 298 and the point indicated at 300 in FIG. 10, the crankpin is gauged. A find feed is then undertaken to the point indicated at 302 in FIG. 10. A second gauging is then performed to check the dimensional accuracy of the crankpin. Upon completion of the second gauging and the dwell indicated at point 304 in FIG. 10, a sparkout occurs to the point indicated at 306. The grinding wheel 12 and steadyrest members 70 and 90 are then retracted and the crankshaft moved axially and indexed to enable a secondary grinding operation to be performed on the next succeeding crankpin.

After a secondary or undersize grinding operation has been performed on all of the crankpins, the crankshaft 18 is removed from the grinding machine 10. It should be noted that the crankshaft 18 remains in the grinding machine 10 during an entire initial grinding operation and the secondary grinding operation. Thus, the crankshaft is placed in the grinding machine 10 prior to beginning of an initial grinding operation and is not removed from the grinding machine 10 until after the secondary grinding operation has been completed. When the secondary grinding operation has been completed, the steadyrest slide motor 32 is activated to move the steadyrest assembly 24 away from the ground crankshaft and the crankshaft is removed by suitable handling mechanism. At this time, the secondary steadyrest drive motors 160 and 250 are activated to return the steadyrest members 70 and 90 to their initial reference positions prior to performing grinding operations on the succeeding crankshafts.

A particular order of steps for a initial grinding operation and a secondary grinding operation has been illustrated in FIG. 10. However, it is contemplated that a different order may be utilized if desired. Specifically, it is contemplated that the steadyrest assembly 24 could be activated to move the steadyrest members 70 and 90 into engagement with a crankpin at approximately the point indicated by the numeral 288 in FIG. 10. If this was done, the grinding wheel would not have to be retracted in the manner indicated by the points 292, 294, and 296 in FIG. 10 and it would be possible to proceed directly from the point indicated at 288 in FIG. 10 to the point indicated at 299 in FIG. 10. It is believed that this mode of operation of the grinding machine 10 may be preferred for many circumstances.

Summary

In view of the foregoing description it is apparent that the present invention provides a new and improved method and apparatus for grinding a workpiece and more specifically a method and apparatus for grinding crankshafts. During the grinding of a crankshaft 18 with the improved apparatus, each of the crankpins 46, 48, 50, and 52 is initially ground to a predetermined diameter. Each of the crankpins is measured to determine if it is out-of-round after the initial grinding operation. Assuming that the crankpin 46 is out-of round by an amount which is greater than the dimensional tolerances for the crankpin but less than an amount which may require scrapping of the crankshaft 18, a secondary grinding operation is undertaken after completion of the initial grinding operation on the other crankpins. In accordance with a feature of the present invention, the initial and secondary grinding operations are performed with the same grinding machine 10 without removing the crankshaft 18 from the grinding machine.

To enable the same grinding machine 10 to be used to perform both the initial and secondary or undersize grinding operations, an improved steadyrest assembly 24 is easily adjusted by a secondary drive assembly 112 to compensate for the smaller size to which the crankpins are ground during the secondary grinding operation. This improved steadyrest assembly 24 can also be quickly and easily adjusted by the secondary drive assembly 112 after performance of the secondary grinding operation to a condition in which it is set to support the pins of a next succeeding crankshaft during an initial grinding operation.

During the grinding of a substantial number of crankshafts, the counters 252 and 253 are effective to detect when the number of crankpins and/or crankshafts requiring secondary grinding operations is excessive. Thus, when the count stored in the counter 252 is greater than a predetermined number due to an excessive number of consecutive crankpins being out-of-round, an output signal from the counter initiates a suitable control function. Similarly, when the count stored in the counter 253 is greater than a predetermined number due to an excessive number of consecutive crankshafts having out-of-round crankpins, an output signal from the counter initiates a suitable control function. Of course, the counters 252 and 253 could be connected with separate control circuits to initiate different control functions if desired.

Having described a specific preferred embodiment of the invention, the following is claimed:

1. An apparatus for use in an initial grinding operation in which a workpiece is ground to a first diameter and in a second grinding operation in which the workpiece is ground to a second diameter which is smaller than the first diameter to which the workpiece is ground during the initial grinding operation, said apparatus comprising a base, a movable steadyrest member, support surface means disposed on said steadyrest member for engaging the workpiece during the initial and second grinding operations, first drive means for moving said steadyrest member relative to said base through a predetermined distance between a first reference position and a second reference position in which said support surface means is closer to the workpiece than in the first reference position by an amount equal to the predetermined distance, second drive means for moving said steadyrest member relative to said base from the first reference position to press said support surface means against the workpiece during the initial grinding operation and for moving said steadyrest member relative to said base from the second references position to press said support surface means against the workpiece during the second grinding operation, said second drive means including means for moving said first drive means through the predetermined distance relative to said base with said steadyrest member upon movement of said steadyrest member between the first and second reference positions, sensor means for detecting when the workpiece is out-of-round upon completion of the initial grinding operation, and control means connected with said sensor means and said first and second drive means for effecting operation of said second drive means to move said steadyrest member relative to said base from the first reference position to engage the workpiece with said support surface means during the initial grinding operation, for effecting operation of said first drive means to move said steadyrest member from the first reference position to the second reference position in response to said sensor means detecting that the workpiece is out-of-round upon completion of the initial grinding operation, and for effecting operation of said second drive means to move said steadyrest member from the second reference position to engage the workpiece with said support surface means during the second grinding operation.

2. An apparatus as set forth in claim 1 wherein said first drive means includes a first motor which is operable to effect movement of said steadyrest member between the first and second reference positions, said second drive means including a second motor which is operable to effect movement of said steadyrest member from the first reference position during the initial grinding operation and from the second reference position during the second grinding operation, said second motor being operable to effect movement of said steadyrest member while said first motor is in an inactive condition.

3. An apparatus as set forth in claim 1 wherein said first drive means includes a first motor and a first drive member, said second drive means including a second motor and a second drive member, one of said drive members being connected with said steadyrest member for movement therewith, said first and second drive means including force transmitting means for holding said first and second drive members against movement relative to each other during operation of one of said motors to effect movement of said steadyrest member under the influence of drive forces transmitted from said one of said motors to said steadyrest member through said first and second drive members, said force transmitting means being operable under the influence of the other one of said first and second motors to move said one of said drive members relative to the other one of said first and second drive members to move said steadyrest member relative to said base.

4. An apparatus as set forth in claim 3 wherein said other motor is connected with said drive members by said force transmitting means for movement with said drive members and said steadyrest member during operation of said one of said motors.

5. An apparatus as set forth in claim 1 further including a second movable steadyrest member disposed on said base, second support surface means disposed on said second steadyrest member for engaging the workpiece during the initial and second grinding operations, third drive means for moving said second steadyrest member relative to said base between a third reference position and a fourth reference position in which said second support surface means is closer to the workpiece than in said third reference position, and fourth drive means for moving said second steadyrest member relative to said base through a second distance from the third reference position to press said second support surface means against the workpiece during said initial grinding operation and for moving said second steadyrest member relative to said base from the fourth reference position through said second distance to press said second support surface means against the workpiece during the second grinding operation.

6. An apparatus as set forth in claim 1 further including means for adjusting the distance between said first and second reference positions.

7. An apparatus as set forth in claim 1 further including third drive means for rotating said steadyrest member about its central axis.

8. An apparatus as set forth in claim 1 further including third drive means for moving said base away from the workpiece to provide a relatively large space between said steadyrest member and the workpiece.

9. An apparatus for use in an initial grinding operation in which a workpiece is ground to a first diameter and in a second grinding operation in which the workpiece is ground to a second diameter which is smaller than the first diameter to which the workpiece is ground during the initial grinding operation, said apparatus comprising a base, a movable steadyrest member disposed on said base, support surface means disposed on said steadyrest member for engaging the workpiece during the initial and second grinding operations, first drive means for moving said steadyrest member relative to said base between a first reference position and a second reference position in which said support surface means is closer to the workpiece than in the first position, second drive means for moving said steadyrest member relative to said base from the first reference position to press said support surface means against the workpiece during the initial grinding operation and for moving said steadyrest member relative to said base from the second reference position to press said support surface means against the workpiece during the second grinding operation, said first drive means including a first motor and a first drive member, said second drive means including a second motor and a second drive member, said first drive member being connected with said steadyrest member for movement therewith, and first and second drive means including force transmitting means for holding said first and second drive members against movement relative to each other during operation of said second motor to effect movement of said steadyrest member under the influence of drive forces transmitted from said second motor to said steadyrest member through said first and second drive members, said force transmitting means being operable under the influence of said first motor to move said first drive member relative to said second drive member to thereby move said steadyrest member and said first drive member relative to said base and said second drive member, sensor means for detecting when the workpiece is out-of-round upon completion of the initial grinding operation, control means connected with said sensor means and said first and second motors for effecting operation of said second motor to move said steadyrest member relative to said base from the first reference position during the initial grinding operation, for effecting operation of said first motor to move said steadyrest member from the first reference position to the second reference position in response to said sensor means detecting that the workpiece is out-of-round upon completion of the intial grinding operation, and for effecting operation of said second motor to move said steadyrest member from the second reference position during the second grinding operation.

10. An apparatus as set forth in claim 9 wherein said first motor is connected with said drive members by said force transmitting means for movement with said drive members and said steadyrest member during operation of said second motor.

11. An apparatus for use in grinding a circular portion of a workpiece during an initial grinding operation and during a second grinding operation in which the workpiece is ground to a smaller size than during the initial grinding operation, said apparatus comprising chuck means for rotating the workpiece during the initial and second grinding operations and for continuously holding the workpiece from the beginning of the initial grinding operation until the end of the second grinding operation, a movable steadyrest member, support surface means disposed on said steadyrest member for engaging the workpiece during the initial and second grinding operations while the workpiece is being rotated by said chuck means, first drive means for moving said steadyrest member between a first reference position and a second reference position in which said support surface means is closer to the workpiece than in the first position, second drive means for moving said steadyrest member from the first reference position to press said support surface means against the workpiece during the initial grinding operation and for moving said steadyrest member relative to said base from the second reference position to press said support surface means against the workpiece during the second grinding operation, detector means for detecting when the circular portion of the workpiece is out-of-round by more than a predetermined distance at the end of the initial grinding operation and while the workpiece is being held by said chuck means, and control means for effecting operation of said second drive means to move said steadyrest member from the first reference position during the initial grinding operation and while the workpiece is held by said chuck means, for effecting operation of said first drive means to move said steadyrest member to the second reference position in response to detection by said detector means that the circular portion of the workpiece is out-of-round by more than the predetermined distance, and for effecting operation of said second drive means to move the steadyrest member away from the second reference position during the second grinding operation and while continuing to hold the workpiece with said chuck means.

12. An apparatus as set forth in claim 11 wherein said control means includes means for maintaining said first drive means in an inactive condition during operation of said second drive means.

13. An apparatus as set forth in claim 11 wherein said second drive means includes means for moving said first drive means with said steadyrest member.

14. An apparatus as set forth in claim 11 wherein said first drive means includes a first motor which is operable to effect movement of said steadyrest member between the first and second reference positions, said second drive means including a second motor which is operable to effect movement of said steadyrest member from the first reference position during the initial grinding operation and from the second reference position during the second grinding operation, said second motor being operable to effect movement of said steadyrest member while said first motor is in an inactive condition, said control means being connected with said first and second motors to enable said control means to effect operation of said first and second motors to move said steadyrest member while the workpiece is held by said chuck means.

15. An apparatus for use in supporting a workpiece during an initial grinding operation and a second grinding operation in which the workpiece is ground to a smaller size than during the initial grinding operation, said apparatus comprising a base, an axially movable steadyrest member disposed on said base, a support surface disposed on said steadyrest member for engaging the workpiece during the initial and second grinding operations, a first drive member connected with said steadyrest member for movement therewith during axial movement of said steadyrest member, a second drive member disposed in a telescopic relationship with said first drive member, force transmitting means for transmitting force between said first and second drive members, first motor means for effecting operation of said force transmitting means to vary the telescopic relationship between said first and second drive members and thereby effect axial movement of said steadyrest member relative to said base, second motor means for moving said first and second drive members together with said steadyrest member relative to said base while said force transmitting means maintains the telescopic relationship between said drive members constant, a rotatable cam member connected with said second drive member, said second motor means being operable to rotate said cam member relative to said second drive member to effect axial movement of said steadyrest member, and control means for effecting operation of said first motor means to operate said force transmitting means to move said steadyrest member relative to said base from a first reference position to a second reference position upon completion of the initial grinding operation and for effecting operation of said second motor means to move said first and second drive members and said steadyrest member together relative to said base during the initial and second grinding operations.

16. An apparatus as set forth in claim 15 wherein said first motor means is connected with said first drive member and steadyrest member for movement therewith during axial movement of said steadyrest member.

* * * * *